United States Patent [19]

Koegel

[11] 4,187,700

[45] Feb. 12, 1980

[54] LATCH GUARD AND DEEP PILE FABRIC CIRCULAR KNITTING MACHINE FITTED THEREWITH

[75] Inventor: Ralph A. Koegel, Brookfield, Wis.

[73] Assignee: Borg Textile Corporation, Oak Brook, Ill.

[21] Appl. No.: 848,100

[22] Filed: Nov. 3, 1977

[51] Int. Cl.[2] ..... D04B 9/14

[52] U.S. Cl. ..... 66/111; 66/9 B

[58] Field of Search ..... 66/9 B, 111

[56] References Cited

U.S. PATENT DOCUMENTS

| | | | |
|---|---|---|---|
| 166,831 | 8/1875 | Westcott | 66/111 X |
| 1,977,522 | 10/1934 | Mills | 66/42 |
| 2,255,078 | 9/1941 | Moore | 66/9 B |
| 2,680,360 | 6/1954 | Schmidt | 66/9 B |
| 3,413,823 | 12/1968 | Bevcus et al. | 66/9 B |

*Primary Examiner*—Wm. Carter Reynolds

*Attorney, Agent, or Firm*—Hill, Van Santen, Steadman, Chiara & Simpson

[57] ABSTRACT

An improved latch guard having a forwardly extending deflector arm integrally associated therewith. When the improved latch guard is incorporated into a deep pile fabric circular knitting machine, the deflector arm eliminates the problem of stray fiber build-up on the front edge of prior art latch guards during operation of such knitting machine.

7 Claims, 9 Drawing Figures

LATCH GUARD AND DEEP PILE FABRIC CIRCULAR KNITTING MACHINE FITTED THEREWITH

BACKGROUND OF THE INVENTION

In circular knitting machines of the type used for making deep pile fabric, a plurality of stationary fiber feeding stations are located at circumferentially spaced positions about a rotating needle cylinder which carries vertically reciprocable knitting needles in slots or grooves in its periphery. Each feeding station has a doffer roll adapted to supply fiber to the needles. A stationary latch guard is employed in the vicinity of the doffer roll of each individual such feeding station to provide assurance that the latch of each needle is maintained in an open position during the interval of time in machine operation when needles are moving upwardly relative to their associated revolving cylinder at each feeding unit into the region of the doffer roll to receive fiber therefrom, followed by movement of fiber-charged needles downwardly away from the doffer roll. Subsequently, the fiber charged needles are circumferentially moved into the region of a yarn charging or feeding station where the needles are charged with yarn and then caused to knit before being recycled in another machine knitting sequence. Typically, a plurality of yarn feeding stations are circumferentially spaced around a single needle cylinder.

Particularly in such knitting machines where the knitting of multi-color fabric patterns is involved, a plurality of fiber feeding stations may preceed each individual yarn feeding station. Experience has shown that such an operating sequence can result in the development of loose or stray fibers in and around the cylinder circumference.

Sufficient stray fiber can occur in regions about the top and upper outer side edge portions of the cylinder to cause a gradual build-up and collection of such stray fibrous material as slugs or fiber balls upon the leading or front edges of the respective individual latch guards. As the build up of such stray fibers upon the latch guard front end portions continues, eventually a point is reached where such a mass or wad or fiber breaks away from such forward end of the latch guard, is carried forwardly about the outer periphery of the cylinder, and becomes engaged with the needles (and sinkers) operating in a fiber feeding station or in a yarn feeding station. The consequence is that the freed fiber ball becomes captured by one or more needles, is knitted into the fabric being produced, so that a fault results.

In a multi-color pattern knitting operation, such a fault results in a noticeable or visible imperfection in the fabric pattern which is considered undesirable and unacceptable from the standpoint of producing a quality, commercially acceptable knitted fabric product.

Since there does not appear to be any convenient or practical way to eliminate the presence of a latch guard from the vicinity of a fiber feeding unit without causing a disastrous number of dropped stitches (caused by some needle latches being closed at the time when fiber is being loaded thereinto by a doffer roll), a considerable need has developed in this field for a means of reliably avoiding, and preferably substantially completely eliminating, the collection and subsequent release of fiber balls from the forward ends of latch guards.

So far as is now known, no one has heretofore succeeded in providing a practical means or technique for minimizing or eliminating such fiber ball production and release problem.

BRIEF SUMMARY OF THE INVENTION

More particularly, in one aspect, the present invention provides an improved latch guard for a circular knitting machine. This latch guard employs a deflector means which projects forwardly from the forward tip region thereof (relative to the direction of rotation of the needle carrying rotating cylinder). The deflector means is preferably characterized by having the radial distance therealong at successive locations measured from the axis of such cylinder continuously increase towards the forward end portion of such deflector means.

In another aspect, the present invention provides an improved deep pile fabric circular knitting machine well suited for manufacturing multi-color patterned deep pile knitted fabric, or the like, which is equipped with a circumferentially located plurality of such so equipped latch guards as above described. A machine so equipped to substantially completely eliminate the fiber ball problem.

In another aspect, this invention relates to a method for minimizing or eliminating the fuzz wad problem in a patterned deep pile fabric circular knitting machine.

An important object of the present invention is to overcome the above indicated disadvantages of the prior art.

Another object of the invention is to provide new and improved means for controlling and eliminating so-called pattern density control problems caused by fiber ball generation and release for incorporation into deep pile multi-color patterned fabric made on a circular knitting machine.

A further object of the invention is to provide an improved, economical, simple technique for achieving fiber ball elimination in knitting operations performed by circular knitting machines in manufacturing patterned deep pile knitted fabric.

Other and further objects, features, advantages, aims, purposes and the like of the present invention will be readily apparent from the following description of certain preferred embodiments thereof taken in conjunction with the accompanying drawings, although variations and modifications may be effective without departing from the spirit and scope of the novel concepts embodied in the disclosure.

DETAILED DESCRIPTION

Figure 1:
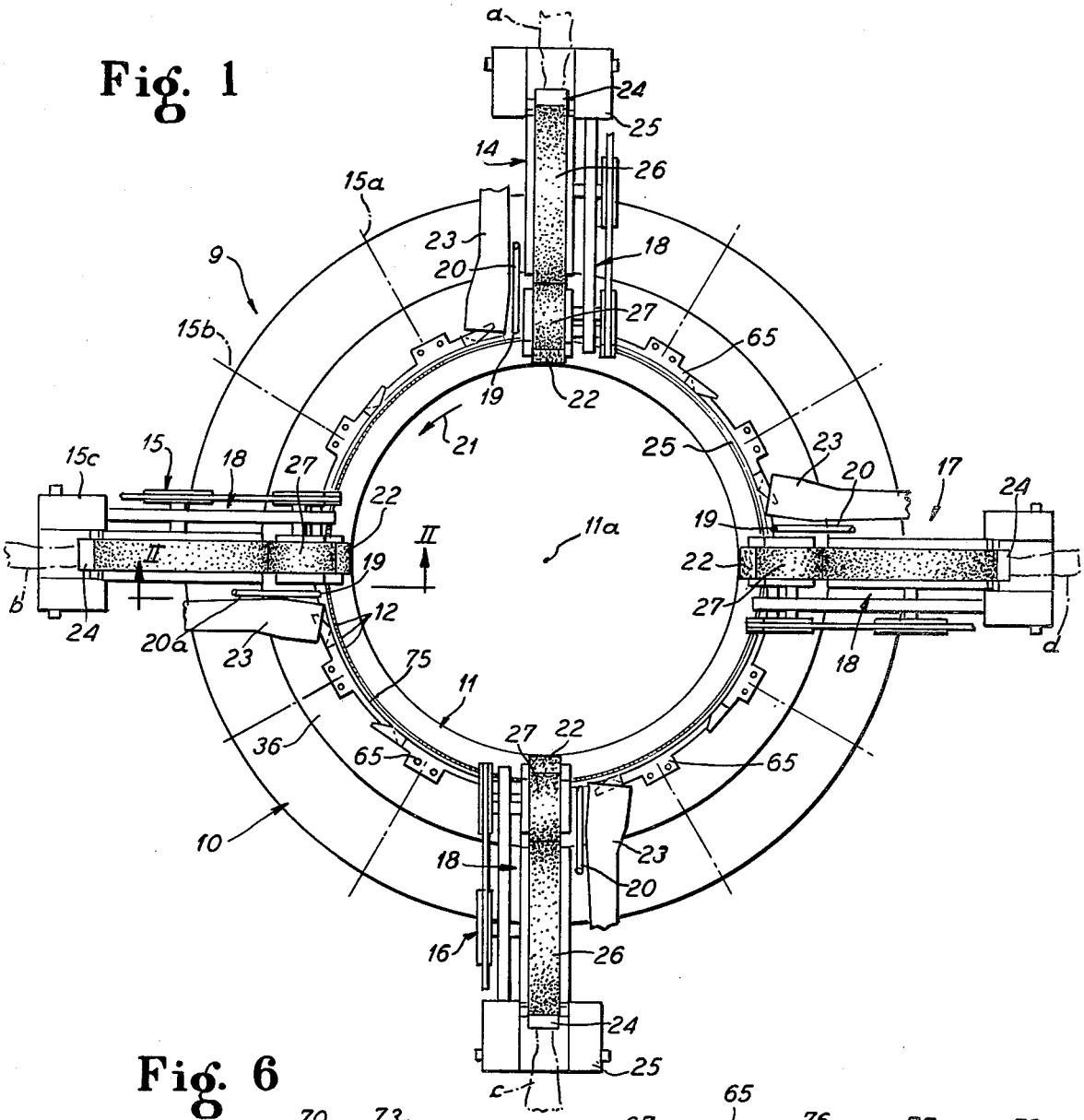
FIG. 1 is a plan view of a circular knitting machine provided with four knitting units.
Figure 6:
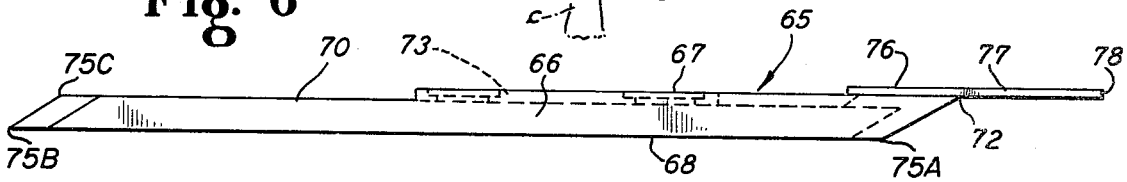
FIG. 6 is a view similar to FIG. 5 but showing another embodiment of a latch guard employed in the present invention.

In FIGS. 1-3 and 8, the general organization of a representative multi-color deep pile fabric circular knitting machine of the type involved in the present invention is illustrated (herein designated in its entirety by the numeral 9). Such a machine may be similar to that generally known to the prior art; see, for examples, Beucus et al U.S. Pat. No. 3,413,823 and Golladay et al U.S. Pat. No. 3,973,414. Knitting machine 9 includes a stationary frame means 10 supporting a rotating needle cylinder 11 carrying vertically reciprocatable knitting needles 12 in slots or grooves on its periphery. Rotary support for the cylinder 11 is provided by the frame 10. Suitably driven pinion means 8 meshes drivingly with a ring gear 7 on the underside of the cylinder 11 and supported by frame 10. As the cylinder 11 rotates, in the counter clockwise direction indicated by directional arrow 21, it brings the needles 12 successively past preselected stationary regions defining fiber feeding stations numbered as 14, 15, 16, and 17 in a projectable circumferential path.

Selected ones of the knitting needles 12 are moved upwardly in programmed sequence to receive or take in their hook portions 12*a* (see FIG. 2) pile fibers from respective fiber feeding units 18 at each of the stations 14 through 17 and a body yarn 19 from a supply yarn tube indicated at 20. In operation, in the feeding unit 18 of each fiber feed station 14 through 17, fibers are transferred to circumferential portions of a doffer roll 22 rotating in one direction, and each of selected knitting needles 12 is reciprocatorily moved by needle cam action to take and remove part of the fibers deposited upon circumferential portions of each doffer roll 22, typically allowing some of the fibers to remain on such circumferential portions. Then, later, after the cylinder 11 has revolved to another position in the vicinity of tube 20, each such selected needle 12 is moved downwardly to draw a loop of the body yarn 19 through a previously formed body yarn loop (not detailed), cast off such previously formed body yarn loop (not detailed), and cause the hooked pile fibers (not detailed) to become interlocked with the body yarn loops. Air ducts 23 supply air jets which are directed towards the needles 12 in the customary manner to orient the pile fibers so that they will protrude from the body yarn loops radially inwardly towards the interior of the knitted tube within the cylinder 11 and to blow away loose fibers (not detailed) in the vicinity of ducts 23. Air is continuously exhausted overhead by appropriate ductwork (not detailed).

The total number of fiber feeding stations, such as 14 through 17, or the like, is typically as great as is permitted by space limitations, and the like, characteristically, because the rate of fabric production is a function of the number of fiber feeds, and production economy is important in the manufacture of competitive deep pile knitted fabrics. However, the number of fiber feeding stations preceding each yarn feeding station is determined by the number of individual fiber colors which are being used in any given machine 9 set up. Here, three fiber feeding stations (not detailed) designated, for example, as 15*a*, 15*b*, and 15*c* predede each yarn feed tube, for example, tube 20*a*. Four sets of fiber feeding stations have thus been illustrated in FIG. 1, one station in each set being diagrammatically shown and designated respectively as 14, 15, 16 and 17, as indicated above, each set having one terminal yarn tube 20. Four courses of yarn body stitches are thus formed during each revolution of the cylinder 11. A greater or lesser number of yarn feeding stations will produce a corresponding greater or lesser number of courses of knitted stitches during each revolution of cylinder 11.

In the illustrated example, each of the fiber feeding units 18 is here illustrated as being of the single fiber feed type so that a single type of fiber input, such as rovings, loose fibers, or slivers, is fed therethrough, but multiple feed type units may be employed, as those skilled in the art will appreciate. For feeding, each of the units 18 incorporates a fiber feed zone or path. Such paths are delineated for illustrative purposes by respective dashed outline rectangles on FIG. 1, and are designated by the letters a, b, c, and d for the stations 14, 15, 16 and 17, respectively. In each such fiber feed path, a back card wheel 24 controlled by mechanism 25, delivers sliver to a carding roll 26. From the carding roll 26, the sliver-derived fibers are taken by an intermediate transfer roll 27 which in turn transfers the fibers to the doffer roll 22.

In a single feeding unit 18, all the rolls are suitably rotatably mounted on frame 10 and driven in unison by suitable means, not shown, to feed fiber to the knitting needles 12. Circumferential surfaces of these rolls are preferably provided with fiber support means, such as a brush-like arrangement of radially outwardly projecting fine wires or the like. Carding roll 26 is of much greater diameter than the transfer roll 27 which may be of about the same diameter as doffer roll 22. Roll relationship is such that the circumferential portions of carding roll 26 are contacted in fiber transferring relation by the circumferential portions of the transfer roll 27 at the opposite side of the carding roll 26 from delivery to such carding roll 26 of fiber. In this orientation rotation of the carding roll 26 may be in a counter-clockwise direction (see, FIG. 2). Rotation of the transfer roll 27 in a clockwise direction is about twice the peripheral speed of that of the carding roll 26. Location of the doffer roll 22 is under the intermediate or transfer roll 27 with the circumferential portions of these two rolls being in fiber transferring interrelationship and with the doffer 22 rotating counter-clockwise at about twice the speed of the transfer roll 27. Location of the doffer roll 22 of a feeding unit 18 relative to the cylinder 11 is over the needles 12 and with the doffer circumferential portions advancing toward hook portions 12*a* (see FIG. 2) of the needles 12 which can thus be each selectively moved by cam action into a position to take a load of fibers from the doffer roll 22.

The cylinder 11 conventionally rotates on a vertical axis under the doffer roll 22 rotating on a horizontal axis 11*a*. Needle cam means is carried by the frame 10 and is represented by selector device 28 acts on the respective butt portions 12*b* of the needles 12 and controls which individual ones of the needles 12 are moved into fiber taking relationship with respect to any given doffer roll 22 at any given fiber feeding station. A selector device 28 can utilize a needle raising cam 42 and electrical actuation means (not detailed). Thus, the butt 12*b* of each needle 12 as cylinder 11 rotates follows a path created by various needle cams 42 circumferentially positioned about frame 10 in radially spaced but adjacent relationship to cylinder 11.

Any convenient or preferred manner of programming the needles 12 to produce a patterned fabric may be employed to cause the needles 12 to cooperate selectively with the individual doffers 22 of each of the various feeding units 18 to transfer fibers from the fiber feeding zones or stations, such as stations 14 through 17, to a fabric being knitted circumferentially about cylinder 11. For present purposes, it is sufficient to illustrate multi-color fabric programming technology by Brandt et al U.S. Pat. No. 3,709,002, but any convenient control technique can be employed. However, according to this patent, not only are control means provided for regulating the quantities of pile fibers delivered to the respective zones, but also pattern means are provided for controlling the needle selector means as well as the control means for regulating the delivered quantities of pile fibers in correlated relation.

In as much as the needles 12 travel with the cylinder 11 past each doffer 22 in a rotary path which extends typically across a portion of the width of the doffer circumferential surface portion, and the doffer roll in each case is itself traveling rotatably, it is clear that the fiber taking path of each needle hook 12*a* along the circumferential surface of each doffer roll 22 is generally helical. In producing any preferred pattern in the pile of a knitted fabric, a plurality of fairly closely spaced needles 12 will usually be simultaneously actuated to take fiber from each doffer roll 22. Since in patterned pile fabric knitting, only certain of the needles 12 are directed to take fiber from any one of the plurality of fiber feed paths employed in any given instance, fibers are generally taken from a doffer roll 22 in only a limited area, and sometimes there are intervals during machine operation in which no needles are selected and therefore no fiber is removed from a doffer roll. The intermediate roll or transfer roll 27 during such intervals will continue to transfer fiber to the doffer continuously. To alleviate the problem of excessive quantities of fibers being collected on the doffer rolls, the technology disclosed in Abler U.S. Pat. No. 4,006,609 may be employed, or otherwise, as desired.

Since weft knitting of Jersey stitches is here being carried out, needles 12 are latch needles which are capable of both forming loops without the assistance of any other loop forming element, and of drawing a loop through a previous one and thus forming a stitch. For purposes of preventing loops previously knitted from moving up the step 12*c* of each needle 12, and thereby interfering with the cast off operation, a plurality of hold down sinkers 29 are employed. The sinkers 29 have no loop forming functions. The sinkers 29 are carried by a platform or sinker ring 38 which moves (revolves) and is coupled with cylinder 11. Races 30 in sinker ring 38 alternately interdigitate sinkers 29 with needles 12. While needles 12 reciprocate in directions parallel to the axis 11*a* of cylinder 11, sinkers 29 reciprocate in directions radial with respect to the axis 11*a* of cylinder 11. The finger-like, integrally formed radially inner end portions of each sinker 29 are positioned and formed for loop positioning and holding functions. Sinkers 29 are typically in the physical form of thin, flattened members which upstand between a pair of circumferentially adjacent needles 12.

Sinkers 29 are slidably carried in radially extending respective slots or races 30 formed in the sinker ring 38 for radial reciprocal movements, the interrelationship between each race 30 and its associated sinker 29 being such that the radially inner end region 31 of each sinker 29 protrudes somewhat radially inwardly beyond the end of its slot 30 even when a sinker 29 has been translated in its radially outermost position by sinker cam action during a given knitting operation. The upper edge of each sinker 29 here has a pair of cam receiving slots 32 and 33 (see FIG. 2) formed therein. Sinker cams 34 and 35 are radially adjacent one another relative to the axis 11A of cylinder 11, but are stationary and located radially spaced adjacent relationship to cylinder 11. The sinker cams 34 and 35 coact with one another and with sinkers 29 to move sinkers 29 individually reciprocally and radially in predetermined, synchronized relationship to needles 12 during reciprocal movements of needles 12. The sinker cams 34 and 35 are fixed to cam plates 36, by means of bolts 37, or the like, and, in turn, the cam plates 36 are bolted to frame 10. The sinker ring 38 which supports the sinkers 29 is guided by a series of bearing plates 39 which is located in spaced adjacent radial relationship to cylinder 11 and extends circumferentially thereabout. Plate 39 is conveniently secured by bolts 40, or the like, to frame 10.

Figure 2:
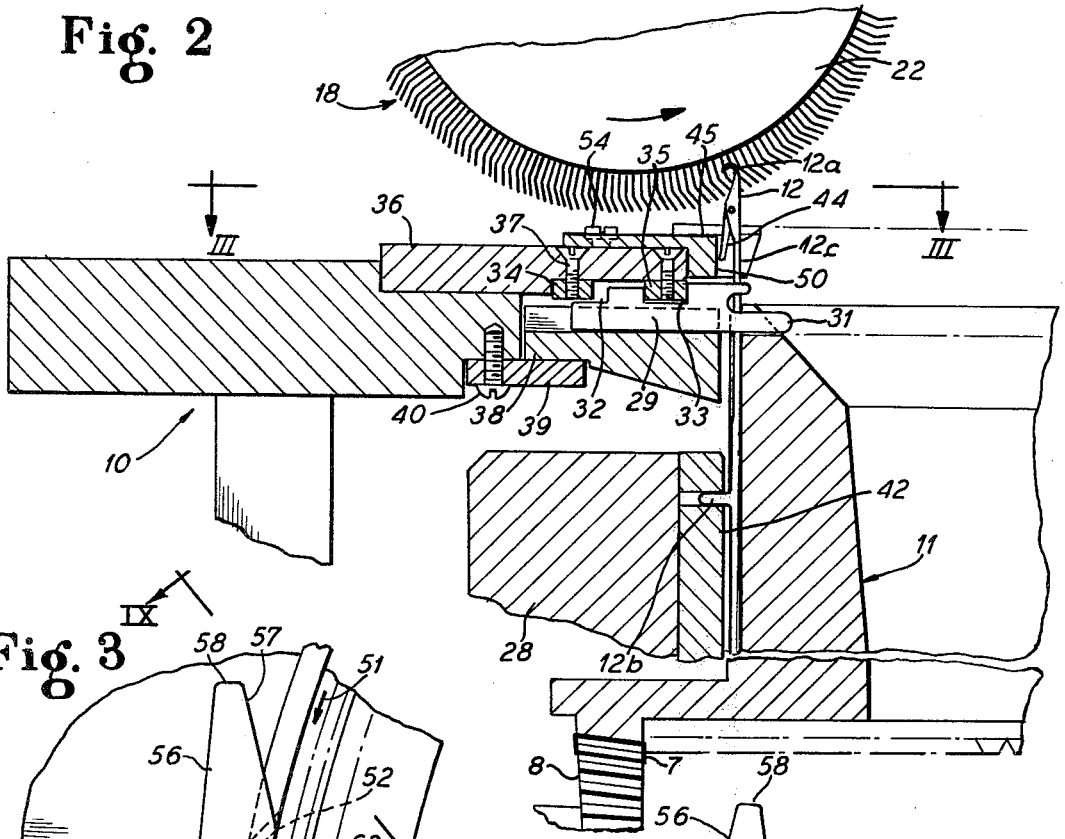
FIG. 2 is a fragmentary, cross-sectional view taken along the line II—II of FIG. 1.
Figure 3:
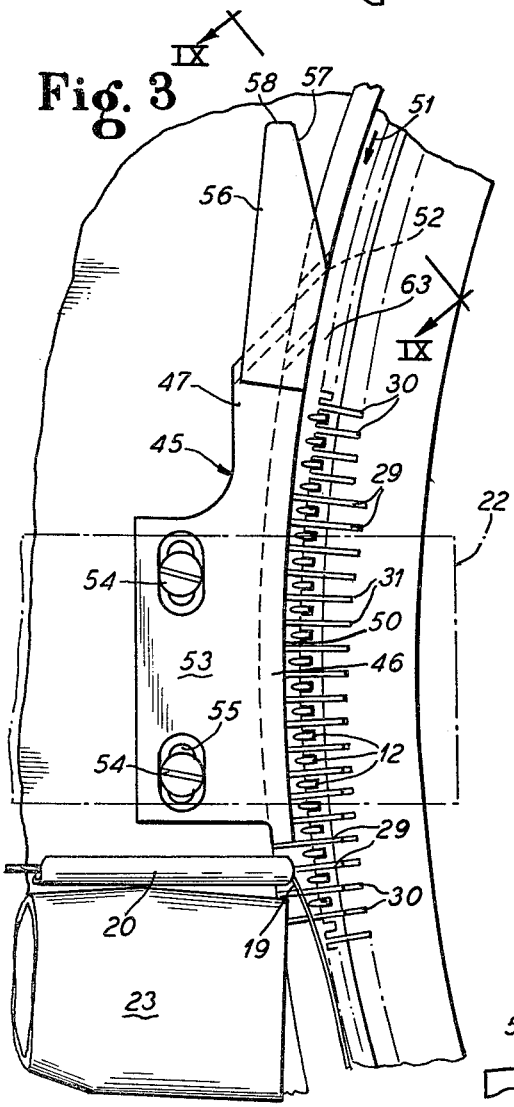
FIG. 3 is a fragmentary, plan view taken along the line III—III of FIG. 2.

As a needle 12 is carried upward by a needle raising cam 42, it reaches its topmost position to take fiber from a doffer wheel 22 and receive yarn from a yarn tube 20. The needle 12 is then at the highest point that it will reach during its knitting cycle. Prior to receiving fiber from a doffer wheel 22, or yarn from a tube 20, each needle 12 rises until its open latch 44 is completely clear of the adjacent fabric loop (not shown), while the adjacent sinker 29 remains in a forward position as shown in FIG. 2 thereby preventing the fabric loops, previously knit, from rising.

In this configuration, a latch guard embodiment 45 or 65 of the present invention is employed in combination with machine 9 for preventing the needle latch 44 of each needle 12 from closing, thus ensuring that hook 12*a* will be able to take fiber from a doffer wheel 22, or yarn from yarn tube 20, as the case may be. Once each needle 12 has taken fiber and yarn within its hook 12*a*, and cylinder 11 has revolved beyond each tube 20, each needle 12 begins to descend into the so-called loop cast-off position. In this position, a latch guard 45 is located, such a latch guard having its rear portion removed, thereby permitting the latch 44 of each needle 12 to close in this region only circumferentially about the cylinder 11. As a needle descends, the adjacent downstream (circumferentially, in the direction of cylinder 11 rotation), sinker 29 is withdrawn, thereby permitting the newly formed loop to be drawn through the previously knitted one. Since the withdrawn sinker 29 is no longer acting as a hold-down device, the "old" loop closes the latch 44 of the needle 12, thus allowing a new stitch to be formed.

Each needle 12 reaches its lowest point (which is adjustable, for example, by means of cam 42 to allow for alteration of stitch size) as the cast-off is completed, and the size of a loop is thus determined. Then, each needle 12 ascends to a so-called "rest" position, after the adjacent sinker 29 moves forward to resume a fabric hold-down position. As those skilled in the art will appreciate, most later model circular knitting machines are equipped with a stitch guard cam means (not detailed), so that when a needle 12 is at its lowest point of stitch formation, and the strain on the yarn is greatest, a cam is present to expedite the ascension of each needle 12 immediately after stitch formation, thereby relieving this strain. Also, such cam means ensures that "loose" or "tight" needles will descend to the same level, resulting in stitch uniformity.

As is well appreciated, the relationship of each sinker 29 to each needle 12 is important in machine operation since the timing of sinker withdrawal and entry at the site of stitch formation must be correct to avoid undesirable yarn strain and subsequent holes, yarn breakage, or distortion. In a proper machine setting, the last needle at the highest point prior to needle descent into the stitch adjusting cam, or equivalent is located. At that point sinker withdrawal commences. Also, the needle at the lowest point of stitch formation is then located prior to ascension. Thus, a sinker should begin to re-enter to perform its hold down function just prior to the point where a first needle commences to ascend.

Figure 5:
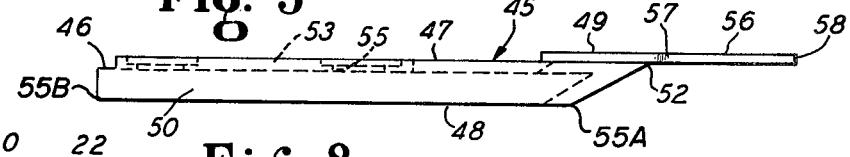
FIG. 5 is a side elevational view of the latch guard shown in FIG. 4.
Figure 8:
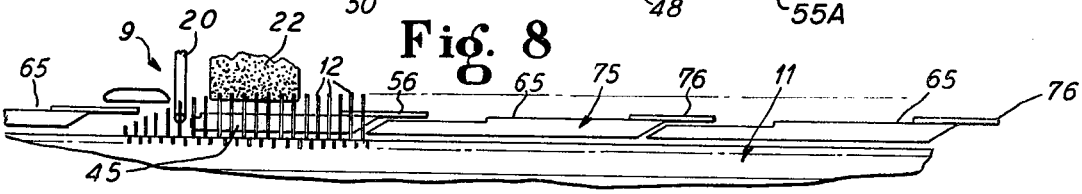
FIG. 8 is a fragmentary view diagrammatically illustrating a perimeter region of about 90° of the machine of FIG. 1 looking radially outwardly from the cylinder thereof, some parts thereof broken away.

In the circular knitting machine 9, each latch guard 45 and 65 incorporates an integral arcuate elongated member 46 and 66, respectively. Each member 46 (and 66) has a spaced, parallel top wall 47 (and 67) and bottom wall 48 (and 68) and the inside face 50 (and 70) is vertically straight and longitudinally curved. The radius of such longitudinal curvature is slightly larger by a preselected amount than the outside radius of the projected circumferential path 51 assumed by each of the plurality of vertically reciprocatable latched needles 12 which are functionally associated with the outside upper rim portions of rotating cylinder 11. The longitudinally upper forward portion 52 (and 62) of the arcuate member 46 (and 66) relative to the predetermined direction of rotation of the cylinder 11 terminates in a point, as shown, for example, in FIGS. 5 (and 6).

Projecting radially outwardly from each arcuate member 46 (and 66), and integrally associated therewith, is a flattened, plate like bracket 53 (and 73) which is adapted for the mounting and rigidifying of arcuate member 46 (and 66) to the top face of the sinker cam plate 36 by means of flat headed 54 (paired) which extend through illustrative apertures 55 (paired) formed in bracket 53. The apertures 55 are circumferentially slotted so as to provide circumferentially adjustability for a latch guard 45 (or 65, if desired) relative to sinker cam plate 36. Any convenient means for mounting a bracket 53 (or 73) to plate 36 may be employed, however. The arcuate member 46 (and 66) depends down over the edge of plate 36 to provide a broad surface for guiding latches 44 of needles 12. The spacing between open latches 44 and inside face 50 is such that normally the latches 44 are not engaged therewith, so face 50 is not a true camming surface as those skilled in the art will appreciate. Latch guards are preferably formed of metal, such as steel or the like.

Thus, a plurality of latch guards 45 and 65 are stationarily located relative to frame 10 circumferentially about the upper route terminal circumferentially extending edge region 25 of the rotatable cylinder 11. Such plurality of latch guards cooperate with one another so that, except in a predetermined region of each yarn feeding assembly, the latch guard members 45 and 65 are in a circumferentially adjacent but circumferentially spaced (for reasons of adjustability and tolerances) relationship to one another. The circumferentially adjacent surfaces are slanted radially diagonally and in inclined spaced relationships from an upper location downwards (from the mouth portion of cylinder 11) so that needle latches 44 will be urged in a desired direction as the cylinder 11 revolves and a minimum region of loose fiber collection is presented in machine 9. The plurality of latch guard members thus defines a circumferentially extending surface 75 about such mouth portion of cylinder 11 which surface 75 is adapted to maintain all individual ones of the latches 44 in radially adjacent relationship thereto open when the needles 12 are moved reciprocatorily and circumferentially in radially adjacent relationship to surface 75.

Taken together, the pinion means 8 (and its associated ring gear 7), the sinker cams 34, 35, the selector drive 28 and needle raising cam 42, and doffer drive mechanism 25 comprise together with associated conventional circular knitting machine elements means to control rotational movements of the cylinder 11, reciprocal movements of the needles 12 and the sinker members 29, and operations of the fiber doffing subassemblies (feeding units) 21, and yarn feeding subassemblies including tube 20 so as to cause a knitting machine 9 to make a tube of deep pile fabric circumferentially around the cylinder 11.

Commencing from a position along top wall 47 (and 67) in spaced relationship to pointed forward portion 52 (and 72) of each latch guard 45 (and 65) a deflector member 56 (and 76) projects forwardly from such pointed portion 52 (and 72). Deflector member 56 (and 76) is integrally associated with the top wall 47 (and 67) as by welding, molding, or the like.

Figure 4:
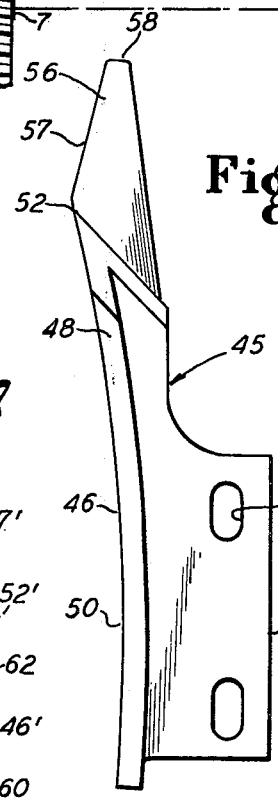
FIG. 4 is a view from the bottom of one embodiment of a latch guard employed in the present invention of the type shown in FIG. 3.

Either at pointed portion 52 (and 72) or slightly forwardly thereof, the inside edge portion 57 (and 77) of deflector member 56 (and 76) recedes, so that the radial distance at successive progressive locations along such inside edge 57 (and 77) of deflector member 56 (and 76) from the axis **11*a* of said cylinder 11 continuously, and preferably linearly, increases proceeding towards the forward end portion 58 (and 78) of the deflector member 56 (and 76). The forward end 56 (and 76) itself can be, and preferably is, blunted, as shown, for example, in FIG. 4. The inside edge portion 57 (and 77) provides a surface which minimizes and usually substantially completely prevents the collection of loose fibers and the development and release into needles 12 of fiber balls as described above, in circular knitting machine 9**.

Preferably, in a latch guard 45 (and 65), as shown, the bracket member 53 (and 73) radially outwardly extends from inside face 50 (and 70) arcuate member 46 (and 66) from an adjacent relationship to the top wall 47 (67). Deflector member 56 (and 76) is preferably in the form of a flattened plate member comprised of a metal, such as steel, or the like.

Figure 7:
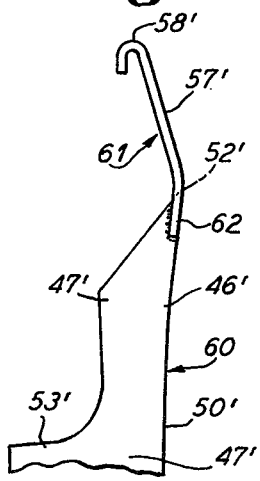
FIG. 7 is a fragmentary view from the top of an alternative embodiment of a latch guard employable in the present invention.
Figure 9:
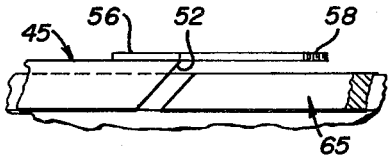
FIG. 9 is a fragmentary elevational view showing the spaced relationship between a pair of adjacent latch guard members and further showing the compound angled surface existing between adjacent end portions of such latch guard members, said FIG. 9 being taken generally along the line IX—IX of FIG. 3.

Another embodiment of a latch guard provided by and used in the present invention is fragmentarily shown in FIG. 7 which is herein designated in its entirety by the numeral 60. Latch guard 60 is similar in construction to latch guard 45, and similar elements are, accordingly, similarly numbered but with the addition of prime marks thereto. In latch guard 60, however, there is utilized a deflector member 61 comprised of a wire member so shaped as to provide an inside edge portion 57' similar to that of deflector member 56. Also, like deflector member 56, a portion 62 of deflector member 61 overlies top wall 47' analogously to a portion 49 of deflector member 56 overlying top wall 47.

Portion 62 is conveniently and preferably welded to a preformed structure comprised of arcuate member 46' and top wall 47'.

In a latch guard, such as 45, 60 or 65, preferably the radial distance of the respective forward end portions 58, 58' or 78 from the path 51 is about 0.5 to 2 centimeters, and the longitudinal distance of such end portions 58, 58' or 78 from such pointed forward portion 52, 52', or 72 is about 1 to 4 centimeters.

A circular knitting machine 9 for manufacturing patterned deep pile knitted fabric, such as described above, thus incorporates a plurality of latch guards, such as described above. Each latch guard 45 and 65 of such plurality is associated with the stationary frame 10 in a spaced relationship to doffer roll 22 and in spaced relationship to the projected circumferential path 51 assumed by said plurality of knitting needles 12 as they vertically reciprocate, at each doffer roll location. Each latch guard is positioned and adapted to maintain the latch 44 of each one of said knitting needles 12 in a fully open configuration during needle reciprocal movements except during a knitting operation. Each latch guard includes means, such as bolts 54, mounting same in an adjacent but radially spaced relationship to the cylinder 11. Each latch guard has an integral deflector member such as 56 (and 76) adapted to guide loosened fiber members into positions circumferentially adjacent cylinder 10 and projecting forwardly from the longitudinally forward upper tip such as 52 (and 72) thereof relative to the direction of rotation of the cylinder 11 with the radial distance at successive locations along said deflector member from the axis 11A of said cylinder continuously increasing towards the forward end portion such as 78 of said deflector member such as 76. The longitudinal upper forward portion such as 72 of each latch guard such as 65 in relation to the mouth of, upper outer edge region, cylinder 11 terminates at a location more forward than the longitudinally lower forward portion such as 75A thereof. The longitudinally lower rear portion such as 75B of each latch guard such as 65 in the same relationship terminates at a location such as 75B more rearward than the longitudinally upper rearward portion such as 75C thereof except for those latch guard members such as 45 which are located in the predetermined regions (near each doffer 22) where knitting is accomplished. In each of these regions, a latch guard member 45 is employed; in all other locations a latch guard 65 is employed. A latch guard 45 has at least a portion of the rear portion thereof (relative to a latch guard 65) removed. A latch guard 45 is so located and positioned that such latch guard 45 is discontinuous in such a predetermined region.

The present invention provides a method for minimizing the development of fluff balls of stray fiber in the vicinity of the doffer roll of a feeding station in a deep pile knitted fabric circular knitting machine. This method can be considered to involve a series of steps, followed during the manufacture of patterned deep pile knitted fabric, such as latch guard positioning, projecting on each latch guard a deflector means on a pointed circumferentially forward longitudinally upper end of each latch guard into the direction of rotation of such machine's cylinder means, and deflecting stray fibers radially towards such cylinder means.

Although the teachings of my invention have herein been discussed with reference to specific theories and embodiments, it is to be understood that these are by way of illustration only and that others may wish to utilize my invention in different designs or applications.

I claim:

1. A latch guard assembly for a circular knitting machine having a rotatable cylinder means with a fixed outside radius and with needles rotatable in a predetermined projected path with said cylinder means, said latch guard assembly being adapted to eliminate stray fiber build up on the front edge of prior art latch guards during operations of such knitting machine, said latch guard comprising (A) an arcuate, elongated guard member having a longitudinal radius of curvature associated with an inside face thereof which is generally somewhat larger by a preselected amount than said outside radius of said predetermined projected circumferential path assumed by each of said needles that are functionally associated with outside upper rim portions of a said cylinder means, a longitudinally forward upper end portion of said guard member, relative to a predetermined direction of rotation of said cylinder means, terminating in a circumferentially more forwardly spatial position than a longitudinally forward circumferentially lower end portion thereof, (B) flattened, substantially horizontally disposed deflector means integrally associated therewith and projecting forwardly from said longitudinally forward upper end portion thereof to a deflector means end, said deflector means being adapted to eliminate pointed regions associated with said latch guard whereon fiber members can accumulate and being further adapted to guide loosened fiber members into positions circumferentially adjacent said cylinder means, during operation of said circular knitting machine, said deflector means being so located relative to said guide member that said deflector means end is from about 0.5 to 2 centimeters radially from said projected path, and also is from about 1 to 4 centimeters longitudinally from said longitudinally forward upper end portion, and (C) mounting means for mounting said latch guard to a predetermined machine support means in a predeterminable relationship to said cylinder means.

2. The latch guard of claim 1 wherein said inside face is transversely straight.

3. The latch guard of claim 1 wherein said inside face is defined by spaced, parallel, transversely spaced wall portions.

4. The latch guard of claim 1 wherein said mounting means comprises a flattened bracket member integrally associated therewith that extends radially relative to said cylinder means away from said inside face.

5. The latch guard of claim 4 wherein said deflector means is a flattened plate associated with an upper portion of said arcuate elongated guard member.

6. The latch guard of claim 4 wherein said deflector means is a wire member associated with an upper portion of said arcuate elongated member.

7. The latch guard of claim 1 wherein said deflector means includes an edge portion adapted to be radially adjacent said cylinder means, said edge portion being so configured that the radial distance from the axis of said cylinder means to said edge portion continuously increases with increasing distances thereof from said forward upper end of said latch guard circumferentially to said deflector means end.

* * * * *

UNITED STATES PATENT AND TRADEMARK OFFICE

CERTIFICATE OF CORRECTION

PATENT NO. : 4,187,700

DATED : February 12, 1980

INVENTOR(S) : Ralph A. Koegel

It is certified that error appears in the above-identified patent and that said Letters Patent are hereby corrected as shown below:

Column 7, lines 16-23, please amend as follows:

distortion. In a proper machine setting, when a [the last] needle is at [the] its highest point prior to needle descent into the stitch adjusting cam, or equivalent [is located. At that point], sinker withdrawal typically commences, and when [. Also,] the needle is at [the] its lowest point of stitch formation [is then located] prior to ascension[. Thus], a sinker should begin to re-enter to perform its hold down function just. [prior to the point where a first needle commences to ascend.]

IN THE CLAIMS:

Claim 3, line 2, cancel "transversely spaced" and insert --top and bottom--.

Signed and Sealed this

Twenty-fourth Day of November 1981

[SEAL]

Attest:

GERALD J. MOSSINGHOFF

Attesting Officer

Commissioner of Patents and Trademarks